US012116990B2

(12) United States Patent
Imai

(10) Patent No.: US 12,116,990 B2
(45) Date of Patent: Oct. 15, 2024

(54) TUBE PUMP

(71) Applicant: Surpass Industry Co., Ltd., Gyoda (JP)

(72) Inventor: Hiroshi Imai, Gyoda (JP)

(73) Assignee: Surpass Industry Co., Ltd., Gyoda (JP)

( * ) Notice: Subject to any disclaimer, the term of this patent is extended or adjusted under 35 U.S.C. 154(b) by 123 days.

(21) Appl. No.: 17/670,125

(22) Filed: Feb. 11, 2022

(65) Prior Publication Data

US 2022/0260070 A1 Aug. 18, 2022

(30) Foreign Application Priority Data

Feb. 12, 2021 (JP) ..... 2021-021120

(51) Int. Cl.
*F04B 43/08* (2006.01)
*F04B 43/12* (2006.01)

(52) U.S. Cl.
CPC ..... *F04B 43/1269* (2013.01)

(58) Field of Classification Search
CPC ..... F04B 43/1253; F04B 45/06; F04B 45/08; F04B 43/08; F04B 43/1269; H02K 16/00; H02K 7/003; B65G 23/08; B65G 23/22
USPC ..... 310/112
See application file for complete search history.

(56) References Cited

U.S. PATENT DOCUMENTS 5,720,590 A * 2/1998 Hofmeister ..... H02K 5/128 414/744.2
6,145,889 A * 11/2000 Imai ..... F16L 27/0816 285/422
7,960,883 B2 * 6/2011 Hishida ..... H02K 16/00 310/22

(Continued)

FOREIGN PATENT DOCUMENTS

EP 3 171 027 B1 1/2020
EP 3 296 570 B1 10/2020

(Continued)

OTHER PUBLICATIONS

Extended European Search Report for European Application No. 22154706.0 dated Jul. 6, 2022.

(Continued)

*Primary Examiner* — Philip E Stimpert
*Assistant Examiner* — Dnyanesh G Kasture
(74) *Attorney, Agent, or Firm* — Muncy, Geissler, Olds & Lowe, P.C.

(57) ABSTRACT

Provided is a tube pump including: first and second roller units that rotate about the axis while being in contact with a tube; a drive shaft arranged on the axis and coupled to the first roller unit; a drive cylinder arranged on the axis and coupled to the second roller unit; a first drive unit configured to rotate the drive shaft in a predetermined direction about the axis and having a first drive shaft configured to rotate about the axis; and a second drive unit configured to rotate the drive cylinder in the predetermined direction about the axis and having a second drive cylinder configured to rotate (Continued)

about the axis, the drive shaft is arranged to penetrate through the second drive unit along the axis, and the drive cylinder is arranged on an outer circumference side of the drive shaft and rotatably about the axis independently of the drive shaft.

10 Claims, 5 Drawing Sheets

(56) References Cited

U.S. PATENT DOCUMENTS

| | | | | |
|---|---|---|---|---|
| 2002/0074891 | A1* | 6/2002 | Gieras | H02K 21/145 310/254.1 |
| 2017/0096995 | A1* | 4/2017 | Imai | F04B 43/1261 |

FOREIGN PATENT DOCUMENTS

| | | | |
|---|---|---|---|
| JP | H07213007 | A | 8/1995 |
| JP | 2017-067054 | A | 4/2017 |
| WO | WO 2005/080794 | A1 | 9/2005 |

OTHER PUBLICATIONS

Office Action for Japanese Patent Application No. 2021-021120 dated May 14, 2024.

* cited by examiner

TUBE PUMP

CROSS-REFERENCE TO RELATED APPLICATIONS

This application is based on Japanese Patent Application No. 2021-021120 filed on Feb. 12, 2021, the contents of which are incorporated herein by reference in its entirety.

BACKGROUND

1. Technical Field

The present disclosure relates to a tube pump.

2. Description of Related Art

In the related art, a tube pump that pressure-feeds a liquid in a tube with flexibility by a plurality of rollers intermittently squeezing the tube is known (see Japanese Unexamined Patent Application, Publication No. 2017-67054, for example). Since the tube pump intermittently pressure-feeds the liquid, pulsation (a state in which an increase and a decrease in flow amount are repeated) is caused in the pressure-fed liquid.

Japanese Unexamined Patent Application, Publication No. 2017-67054 discloses that in order to curb such pulsation, the pressure of the liquid in the tube blocked due to contact with a pair of roller units is boosted when one of the pair of roller units passes through a separation position at which the roller units are separated from the tube. According to Japanese Unexamined Patent Application, Publication No. 2017-67054, it is possible to curb the phenomenon that the liquid is drawn to the side of the tube pump by boosting the pressure of the liquid in the tube.

In the tube pump disclosed in Japanese Unexamined Patent Application Publication No. 2017-67054, a drive shaft that drives one of the pair of roller units is driven by a first drive shaft of a first drive unit arranged coaxially with the drive shaft.

On the other hand, a drive cylinder that drives the other of the pair of roller units is driven by a second drive shaft of a second drive unit arranged at a different position not coaxial with the drive cylinder. Drive force generated by the second drive unit is transmitted from a first gear unit attached to the second drive shaft to a second gear unit attached to the drive cylinder.

BRIEF SUMMARY

In the tube pump disclosed in Japanese Unexamined Patent Application Publication No. 2017-67054, however, the drive cylinder that drives the other of the pair of roller units and the second drive shaft of the second drive unit are not arranged coaxially, and this may cause vibration when drive force is transmitted from the first gear unit attached to the second drive shaft to the second gear unit attached to the drive cylinder. Since the first gear unit and the second gear unit are required for transmitting drive force from the second drive shaft to the drive cylinder, this may result in complex structure, increase the number of components or the number of assembly steps, and increase manufacturing cost.

The present disclosure has been made in view of such circumstances and intends to provide a tube pump that can suppress vibration caused by transmission of drive force when independently driving a pair of contact units by using different drive units, respectively, to transmit the drive force from a pair of drive units to the pair of contact units and can reduce manufacturing cost.

The present disclosure employs the following solutions in order to solve the problem described above.

A tube pump according to one aspect of the present disclosure includes: a housing unit formed in an arc shape about an axis and having an inner circumferential surface on which a flexible tube is arranged; a first contact unit configured to rotate about the axis while being in contact with the tube housed in the housing unit; a second contact unit configured to rotate about the axis while being in contact with the tube; a drive shaft arranged on the axis and coupled to the first contact unit; a drive cylinder arranged on the axis and coupled to the second contact unit; a first drive unit configured to rotate the drive shaft in a predetermined direction about the axis and having a first drive shaft arranged on the axis; and a second drive unit configured to rotate the drive cylinder in the predetermined direction about the axis and having a second drive shaft arranged on the axis, the drive shaft is arranged so as to penetrate through the second drive unit along the axis, and the drive cylinder is arranged on an outer circumference side of the drive shaft and rotatably about the axis independently of the drive shaft.

According to the tube pump of one aspect of the present disclosure, the tube pump has the first contact unit and the second contact unit and has the first drive unit and the second drive unit that rotates the first contact unit and the second contact unit in a predetermined direction about the axis, respectively, and thereby the pair of roller units configured to rotate in contact with the tube held in an arc shape about the axis by the housing unit can rotate independently of each other about the axis. The drive force by which the first drive unit rotates the first drive member in a predetermined direction about the axis is transmitted to the first contact unit via the drive shaft penetrating through the second drive unit along the axis. Further, the drive force by which the second drive unit rotates the second drive member in a predetermined direction about the axis is transmitted to the second contact unit via the drive cylinder.

According to the tube pump of one aspect of the present disclosure, the first drive unit rotates the first drive member coaxially with the drive shaft to transmit drive force, and the second drive unit rotates the second drive member coaxially with the drive cylinder to transmit drive force. Thus, there is no need to use a gear for transmission of drive force from the first drive unit to the drive shaft, and there is no need to use a gear for transmission of drive force from the second drive unit to the drive cylinder. It is therefore possible to provide the tube pump that can suppress vibration caused by transmission of drive force when independently driving a pair of contact units by using different drive units, respectively, to transmit the drive force from the pair of drive units to the pair of contact units and can reduce manufacturing cost.

In the tube pump of one aspect of the present disclosure, the first drive unit may have a first pulse motor configured to rotate the first drive member in the predetermined direction, the second drive unit may have a second pulse motor configured to rotate the second drive member in the predetermined direction, the first drive member may be coupled to the drive shaft so as to integrally rotate with the drive shaft, and the second drive member may be coupled to the drive cylinder so as to integrally rotate with the drive cylinder.

According to the tube pump with the above configuration, the first drive unit having the first pulse motor rotates the drive shaft integrally with the first drive member, and the second drive unit having the second pulse motor rotates the drive cylinder integrally with the second drive member. Since the drive shaft rotates at the same speed as the rotation speed at which the first pulse motor rotates the first drive member, the rotation speed of the first pulse motor when the drive shaft is rotated at a predetermined rotation speed can be smaller than in a case where the first pulse motor rotates the drive shaft via a reducer.

Similarly, since the drive cylinder rotates at the same speed as the rotation speed at which the second pulse motor rotates the second drive member, the rotation speed of the second pulse motor when the drive cylinder is rotated at a predetermined rotation speed can be smaller than in a case where the second pulse motor rotates the drive cylinder via a reducer. In such a way, by reducing the rotation speeds of the pulse motors when the drive shaft and the drive cylinder are rotated at predetermined rotation speeds, it is possible to suppress a failure of step-out of the pulse motor when the drive shaft and the drive cylinder are rotated at a high speed.

In the tube pump of one aspect of the present disclosure, the tube pump may include a radial bearing having an outer wheel fixed to the first contact unit and an inner wheel fixed to the second contact unit.

According to the tube pump of the above configuration, the first contact unit coupled to the drive shaft is fixed to the outer wheel of the radial bearing, and the second contact unit coupled to the drive cylinder is fixed to the inner wheel of the radial bearing. The drive shaft and the drive cylinder are positioned relative to the outer wheel and the inner wheel of the radial bearing, respectively. This can ensure that the drive shaft and the drive cylinder are arranged coaxially with each other to rotate about the axis independently without coming into contact with each other.

In the tube pump of one aspect of the present disclosure, it is preferable that the first drive unit and the second drive unit be arranged such that a first arrangement position of the first drive unit in a direction orthogonal to the axis and a second arrangement position of the second drive unit in the direction orthogonal to the axis overlap each other.

According to the tube pump of the above configuration, since the first arrangement position of the first drive unit and the second arrangement position of the second drive unit in the direction orthogonal to the axis overlap each other, the size of the tube pump in the direction (radial direction) orthogonal to the axis can be smaller than in a case where these positions do not overlap. This enables a smaller space in the radial direction required for installing the first drive unit and the second drive unit.

According to the present disclosure, it is possible to provide a tube pump that can suppress vibration caused by transmission of drive force when independently driving a pair of contact units by using different drive units, respectively, to transmit the drive force from a pair of drive units to the pair of contact units and can reduce manufacturing cost.

DETAILED DESCRIPTION

Figure 1:
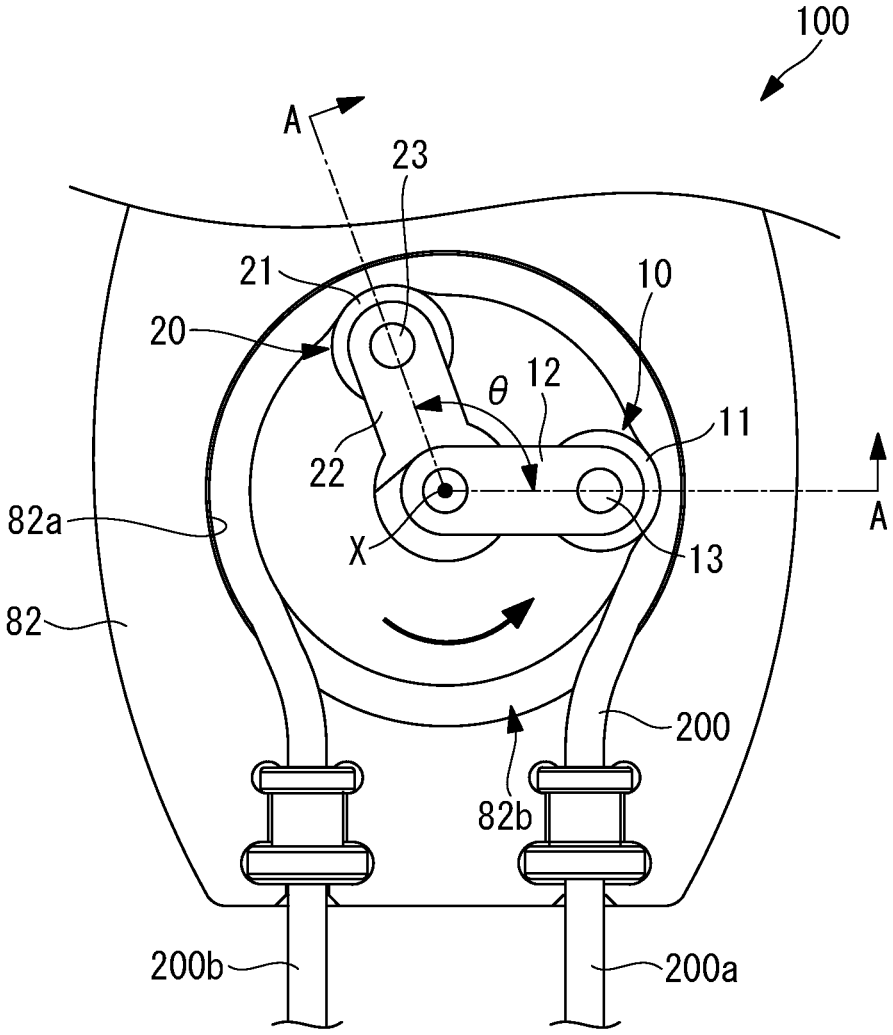
FIG. 1 is a plan view illustrating an embodiment of a tube pump.
Figure 2:
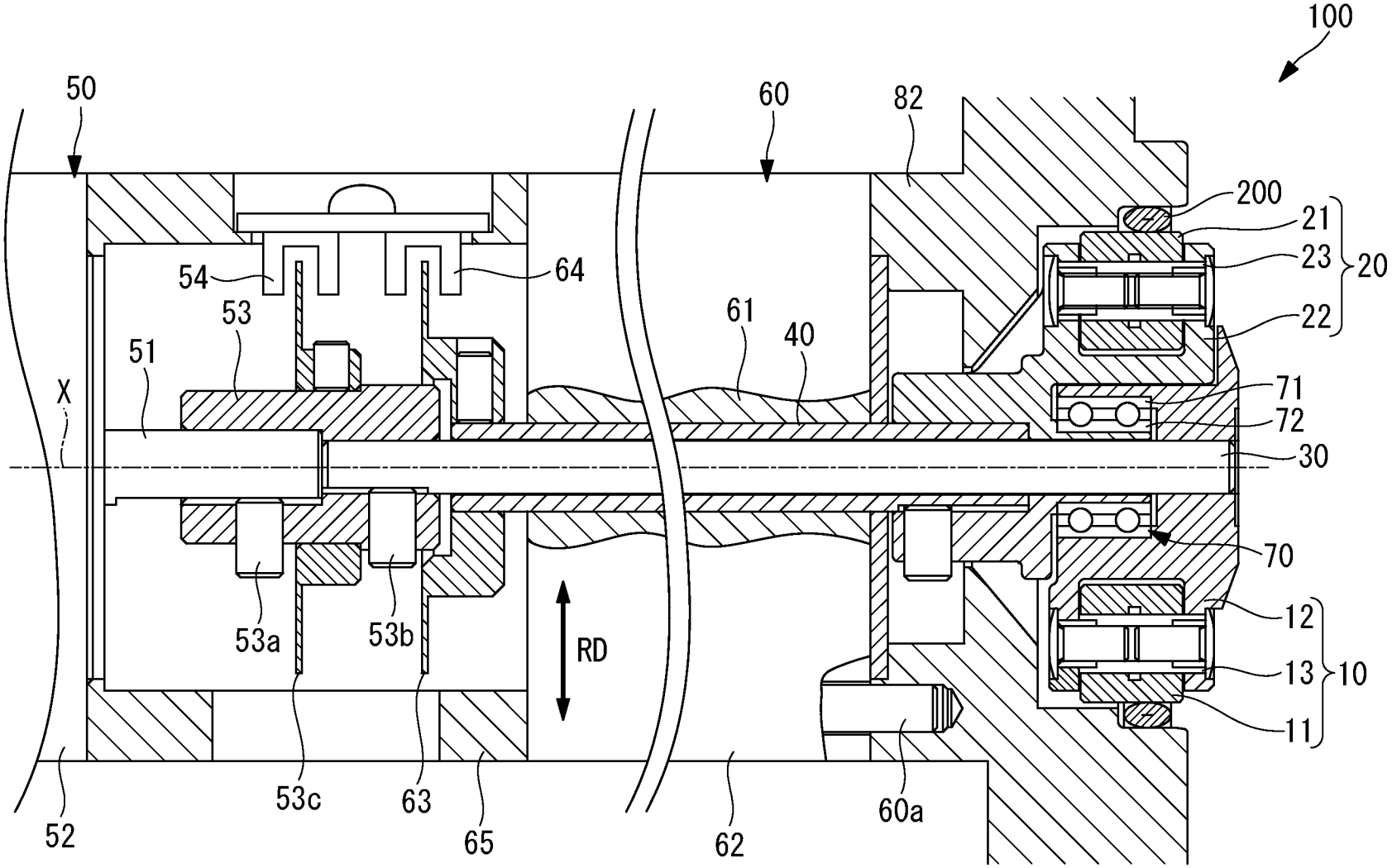
FIG. 2 is a longitudinal cross-sectional arrow view along A-A of the tube pump illustrated in FIG. 1.

Hereinafter, a tube pump (peristaltic pump) 100 according to an embodiment of the present disclosure will be described with reference to drawings. FIG. 1 is a plan view illustrating an embodiment of the tube pump 100. FIG. 2 is a longitudinal cross-sectional arrow view along A-A of the tube pump 100 illustrated in FIG. 1.

The tube pump 100 according to the present embodiment illustrated in FIG. 1 is a device that ejects a liquid, which has flowed from a flowing-in side 200*a* and is stored in a tube 200, to a flowing-out side by causing a first roller unit 10 and a second roller unit 20 to rotate about an axis X (first axis) in the same direction.

As illustrated in the plan view of FIG. 1, the tube 200 with flexibility is disposed in an arc shape around the axis X in the tube pump 100 along an inner peripheral surface 82*a* of a housing unit 82 that accommodates the first roller unit 10 and the second roller unit 20. The inner peripheral surface 82*a* is a surface, which is formed in an arc shape around the axis X, along which the tube 200 is disposed. The housing unit 82 has a recessed part 82*b* that is opened toward one end side along the axis X and accommodates the first roller unit 10 and the second roller unit 20.

As shown in FIG. 1, the first roller unit 10 and the second roller unit 20 housed in the housing unit 82 rotate around the axis X along a counter-clockwise rotation direction (a direction shown by an arrow in FIG. 1) while being in contact with the tube 200.

As illustrated in FIG. 2, the tube pump 100 of the present embodiment includes a first roller unit (first contact unit) 10 and a second roller unit (second contact unit) 20 that rotate about the axis X with the tube 200 being closed, a drive shaft 30 arranged on the axis X and coupled to the first roller unit 10, a drive cylinder 40 coupled to the second roller unit 20, a first drive unit 50 that transmits drive force to the drive shaft 30, a second drive unit 60 that transmits drive force to the drive cylinder 40, and a radial bearing 70.

Figure 3:
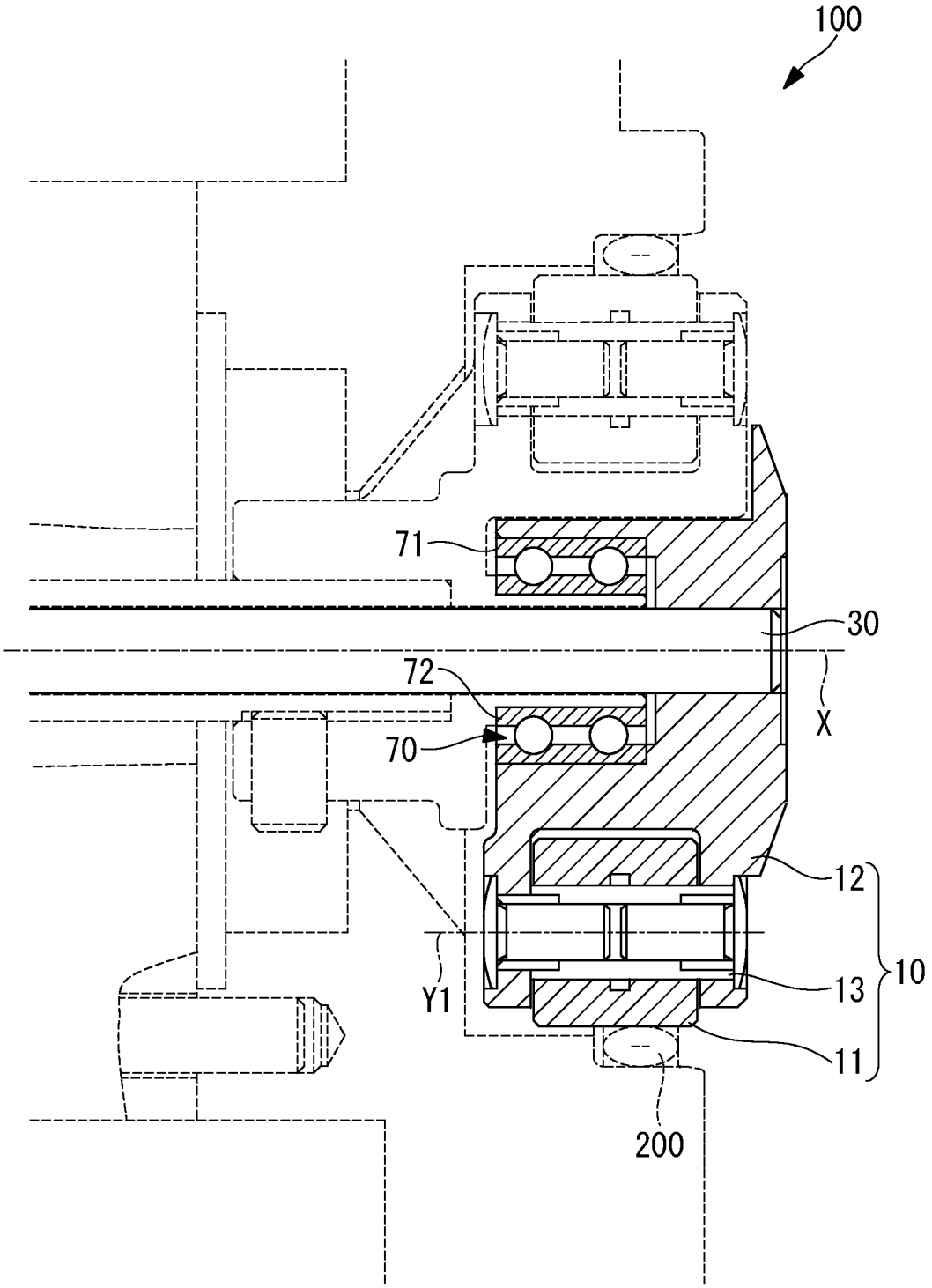
FIG. 3 is a longitudinal cross-sectional view illustrating a structure in which a first drive unit illustrated in FIG. 1 transmits a drive force to a first roller unit.

The first roller unit 10 has a first roller 11 that rotates about an axis parallel to the axis X while being in contact with the tube 200, a first roller support member 12 coupled to the drive shaft 30 so as to integrally rotate about the axis X, and a first roller shaft 13 whose both ends are supported by the first roller support member 12 and which attaches the first roller 11 so as to be rotatable about an axis Y1 (see FIG. 3).

The first drive unit 50 transmits, to the drive shaft 30, drive force used for rotating the first roller unit 10 in a rotation direction that is counterclockwise about the axis X. The first roller support member 12 is coupled to the drive shaft 30 and rotates counterclockwise about the axis while supporting the first roller 11.

Figure 4:
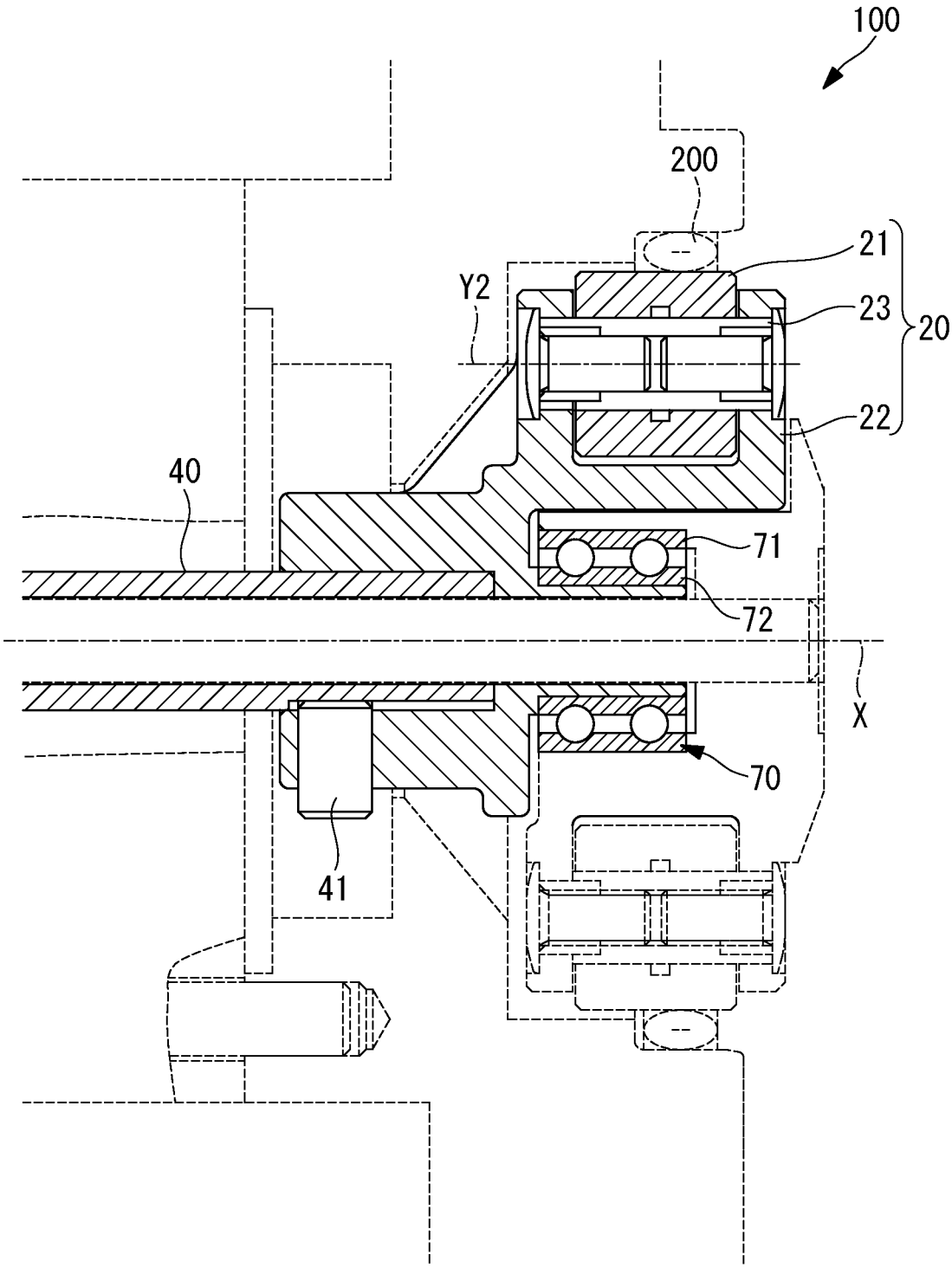
FIG. 4 is a longitudinal cross-sectional view illustrating a structure in which a second drive unit illustrated in FIG. 1 transmits a drive force to a second roller unit.

The second roller unit 20 has a second roller 21 that rotates about an axis parallel to the axis X while being in contact with the tube 200, a second roller support member 22 coupled to the drive cylinder 40 so as to integrally rotate about the axis X, and a second roller shaft 23 whose both ends are supported by the second roller support member 22 and which attaches the second roller 21 so as to be rotatable about an axis Y2 (see FIG. 4).

The second drive unit 60 transmits, to the drive cylinder 40, drive force used for rotating the second roller unit 20 in a rotation direction that is counterclockwise about the axis X. The second roller support member 22 is coupled to the drive cylinder 40 and rotates counterclockwise about the axis while supporting the second roller 21.

The first drive unit 50 is fixed to a casing (not illustrated), and the second drive unit 60 is fixed by a fastening bolt 60*a* to a housing unit 82 forming a part of the casing. The housing unit 82 is a member for housing the first roller unit 10 and the second roller unit 20 therein. A spacer 65 is arranged between the first drive unit 50 and the second drive unit 60 so that a first pulse motor 52 and a second pulse motor 62 described later are spaced apart from each other by a certain distance in the axis X direction.

Next, the structure in which the first drive unit 50 transmits drive force to the first roller unit 10 will be described with reference to FIG. 2 and FIG. 3. In FIG. 3, portions indicated by solid lines are portions forming the structure to transmit the drive force of the first drive unit 50 to the first roller unit 10.

As illustrated in FIG. 2, the first drive unit 50 has a first drive shaft (first drive member) 51 that rotates about the axis X, the first pulse motor 52, and a coupling member 53. The coupling member 53 extending cylindrically along the axis X is fixed to the first drive shaft 51 by a locking screw 53*a*. Further, the coupling member 53 is fixed to the drive shaft 30 by a locking screw 53*b*.

The first drive shaft 51 is coupled to the drive shaft 30 via the coupling member 53. Thus, the first drive unit 50 rotates the drive shaft 30 in a predetermined direction about the axis X by rotating the first drive shaft 51 in a predetermined direction about the axis X by the first pulse motor 52.

A position detecting member 53*c* that rotates about the axis X together with the coupling member 53 is attached to the coupling member 53. In the position detecting member 53*c*, a slit (not illustrated) for detecting the rotation position about the axis X of the first roller unit 10 is formed circumferentially about the axis X in the outer circumferential edge formed in an annular shape.

As illustrated in FIG. 2, a first position detection sensor 54 is arranged so as to interpose the outer circumferential edge of the position detecting member 53*c*. The first position detection sensor 54 is a sensor in which a light emitting element is arranged on one of a pair of faces interposing the position detecting member 53*c* and a light receiving element is arranged on the other. The first position detection sensor 54 detects, at the light receiving element, passage of light emitted by the light emitting element through a slit in response to rotation of the position detecting member 53*c* about the axis X, thereby detects a rotation position indicating which position around the axis X the first roller unit 10 is arranged at, and transmits the detected position to a control unit 90 (see FIG. 5).

As illustrated in FIG. 3, the tip of the drive shaft 30 is coupled into the first roller support member 12. The first roller support member 12 is fixed to an outer wheel 71 of the radial bearing 70. The drive shaft 30 is supported by the radial bearing 70 rotatably about the axis X via the first roller support member 12. Thus, the drive shaft 30 rotates smoothly about the axis X while maintaining the center axis on the axis X. As described above, the drive force by which the first drive unit 50 rotates the first drive shaft 51 about the axis X is transmitted from the first drive shaft 51 to the first roller unit 10 via the drive shaft 30.

Next, the structure in which the second drive unit 60 transmits drive force to the second roller unit 20 will be described with reference to FIG. 2 and FIG. 4. In FIG. 4, portions indicated by solid lines are portions forming the structure to transmit the drive force of the second drive unit 60 to the second roller unit 20.

As illustrated in FIG. 2, the second drive unit 60 has a second drive cylinder (second drive member) 61 arranged on the axis X and the second pulse motor 62. The inner circumferential surface of the second drive cylinder 61 is fixed to the outer circumferential surface of the drive cylinder 40. Thus, the second drive unit 60 rotates the second drive cylinder 61 in a predetermined direction about axis X by using the second pulse motor 62 and thereby rotates the drive cylinder 40 in a predetermined direction about the axis X.

As illustrated in FIG. 2, a position detecting member 63 that rotates about the axis X together with the drive cylinder 40 is attached to the outer circumferential surface of the drive cylinder 40. In the position detecting member 63, a slit (not illustrated) for detecting the rotation position about the axis X of the second roller unit 20 is formed circumferentially about the axis X in the outer circumferential edge formed in an annular shape.

As illustrated in FIG. 2, a second position detection sensor 64 is arranged so as to interpose the outer circumferential edge of the position detecting member 63. The second position detection sensor 64 is a sensor in which a light emitting element is arranged on one of the upper side and the under side and a light receiving element is arranged on the other of the upper side and the under side. The second position detection sensor 64 detects, at the light receiving element, passage of light emitted by the light emitting element through a slit in response to rotation of the position detecting member 63 about the axis X, thereby detects a rotation position indicating which position around the axis X the second roller unit 20 is arranged at, and transmits the detected position to a control unit 90 (see FIG. 5).

As illustrated in FIG. 4, the tip of the drive cylinder 40 is coupled to the second roller support member 22 by a locking screw 41. The second roller support member 22 is fixed to an inner wheel 72 of the radial bearing 70. The drive cylinder 40 is supported by the radial bearing 70 rotatably about the axis X via the second roller support member 22.

Thus, the drive cylinder 40 rotates smoothly about the axis X while maintaining the center axis on the axis X. As described above, the drive force by which the second drive unit 60 rotates the second drive cylinder 61 about the axis X is transmitted from the second drive cylinder 61 to the second roller unit 20 via the drive cylinder 40.

As illustrated in FIG. 2, the drive shaft 30 is arranged so as to penetrate through the second pulse motor 62 of the second drive unit 60 along the axis X. Further, the drive cylinder 40 is arranged so as to penetrate through the second pulse motor 62 of the second drive unit 60 along the axis X.

Further, the drive shaft 30 is fixed to the outer wheel 71 of the radial bearing 70 via the first roller support member 12, and the drive cylinder 40 is fixed to the inner wheel 72 of the radial bearing 70 via the second roller support member 22. Thus, the drive cylinder 40 is arranged rotatably about the axis X independently of the drive shaft 30 on the outer circumference side of the drive shaft 30.

As illustrated in FIG. 2, the first drive unit 50 and the second drive unit 60 are arranged such that the first arrangement position of the first pulse motor 52 in the radial direction RD orthogonal to the axis X and the second arrangement position of the second pulse motor 62 match. Thus, the size of the tube pump 100 in the radial direction RD can be smaller than in a case where these positions do not match in the radial direction RD. Note that the first arrangement position of the first pulse motor 52 and the second arrangement position of the second pulse motor 62 may be arranged so as to partially overlap each other instead of completely matching.

Figure 5:
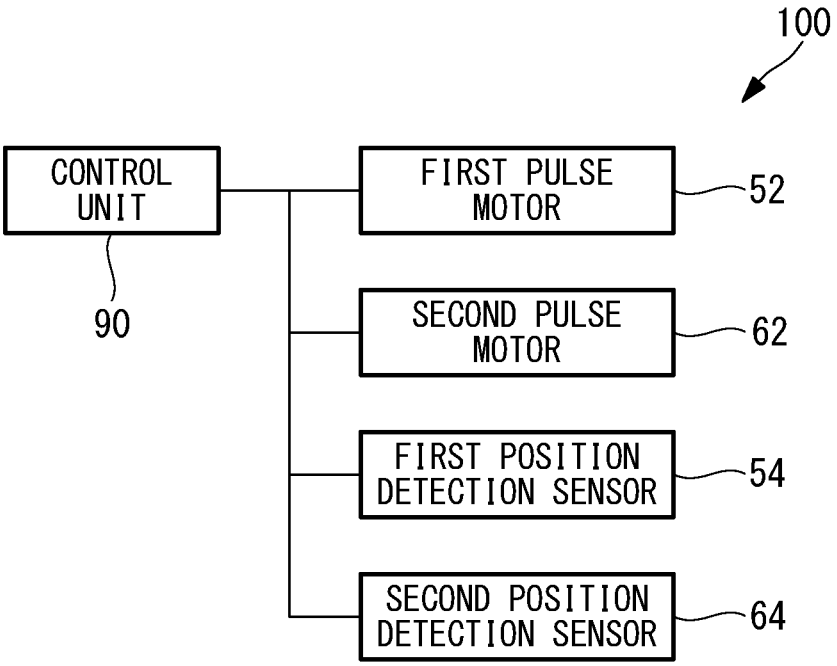
FIG. 5 is a block diagram illustrating a control configuration of the tube pump illustrated in FIG. 1.

Next, the control configuration of the tube pump 100 of the present embodiment will be described. FIG. 5 is a block diagram illustrating a control configuration of the tube pump 100 illustrated in FIG. 1. As illustrated in FIG. 5, the tube pump 100 of the present embodiment includes the control unit 90 that controls the first pulse motor 52 and the second pulse motor 62.

The control unit 90 of the present embodiment transmits pulse signals to the first pulse motor 52 and the second pulse motor 62, respectively, and independently controls the first pulse motor 52 and the second pulse motor 62, respectively. The control unit 90 can detect the rotation position about the axis X of the first roller unit 10 in response to receiving a signal transmitted from the first position detection sensor 54. Further, the control unit 90 can detect the rotation position about the axis X of the second roller unit 20 in response to receiving a signal transmitted from the second position detection sensor 64.

The tube pump 100 of the present embodiment can implement an ejection control mode in which the control unit 90 controls the first pulse motor 52 and the second pulse motor 62 to rotate the first roller unit 10 and the second roller unit 20 in the same direction so that ejection of a liquid in the tube 200 by the first roller unit 10 and the second roller unit 20 is performed.

When the ejection control mode is implemented, the operator sets, via an input unit (not illustrated), a flow rate of a liquid to be ejected by the tube pump 100 to the flowing-out side 200*b*. The control unit 90 controls the first pulse motor 52 and the second pulse motor 62 so that a liquid at the set flow rate is ejected to the flowing-out side 200*b*.

The control unit 90 of the present embodiment adjusts an angle difference θ of the rotation position about the axis X between the first roller unit 10 and the second roller unit 20 illustrated in FIG. 1 when implementing the ejection control mode. The control unit 90 adjusts the angle difference θ so that one of the first roller unit 10 and the second roller unit 20 comes close to the other when one of the first roller unit 10 and the second roller unit 20 is spaced away from the tube 200.

Such an operation can increase the pressure of a liquid inside the tube 200 closed by the first roller unit 10 and the second roller unit 20 when the one of the first roller unit 10 and the second roller unit 20 is spaced away from the tube 200. Thus, the liquid is drawn from the flowing-out side 200*b* to the flowing-in side 200*a* of the tube 200, and this can suppress pulsation of the liquid from occurring.

Effects and advantages achieved by the tube pump 100 of the present embodiment described above will be described.

According to the tube pump 100 of the present embodiment, the tube pump 100 has the first roller unit 10 and the second roller unit 20 and has the first drive unit 50 and the second drive unit 60 that rotates the first roller unit 10 and the second roller unit 20 in a predetermined direction about the axis X, respectively, and thereby the first roller unit 10 and the second roller unit 20 configured to rotate in contact with the tube 200 held in an arc shape about the axis X by the housing unit 82 can be rotated independently of each other about the axis X.

The drive force by which the first drive unit 50 rotates the first drive shaft 51 in a predetermined direction about the axis X is transmitted to the first roller unit 10 via the drive shaft 30 penetrating through the second drive unit 60 along the axis X. Further, the drive force by which the second drive unit 60 rotates the second drive cylinder 61 in a predetermined direction about the axis X is transmitted to the second roller unit 20 via the drive cylinder 40.

According to the tube pump 100 of the present embodiment, the first drive unit 50 rotates the first drive shaft 51 coaxially with the drive shaft 30 to transmit drive force, and the second drive unit 60 rotates the second drive cylinder 61 coaxially with the drive cylinder 40 to transmit drive force. Thus, there is no need to use a gear for transmission of drive force from the first drive unit 50 to the drive shaft 30, and there is no need to use a gear for transmission of drive force from the second drive unit 60 to the drive cylinder 40. It is therefore possible to provide the tube pump 100 that can suppress vibration caused by transmission of drive force when independently driving the first roller unit 10 and the second roller unit 20 by using different drive units, respectively, to transmit the drive force from the first drive unit 50 and the second drive unit 60 to the first roller unit 10 and the second roller unit 20 and can reduce manufacturing cost.

According to the tube pump 100 of the present embodiment, the first drive unit 50 having the first pulse motor 52 rotates the drive shaft 30 integrally with the first drive shaft 51, and the second drive unit 60 having the second pulse motor 62 rotates the drive cylinder 40 integrally with the second drive cylinder 61. Since the drive shaft 30 is rotated at the same speed as the rotation speed at which the first pulse motor 52 rotates the first drive shaft 51, the rotation speed of the first pulse motor 52 when the drive shaft 30 is rotated at a predetermined rotation speed can be smaller than in a case where the first pulse motor 52 rotates the drive shaft 30 via a reducer.

Similarly, since the drive cylinder 40 is rotated at the same speed as the rotation speed at which the second pulse motor 62 rotates the second drive cylinder 61, the rotation speed of the second pulse motor 62 when the drive cylinder 40 is rotated at a predetermined rotation speed can be smaller than in a case where the second pulse motor 62 rotates the drive cylinder 40 via a reducer. In such a way, by reducing the rotation speeds of the pulse motors when the drive shaft 30 and the drive cylinder 40 are rotated at predetermined rotation speeds, it is possible to suppress a failure of step-out of the pulse motor when the drive shaft 30 and the drive cylinder 40 are rotated at a high speed.

According to the tube pump 100 of the present embodiment, the first roller unit 10 coupled to the drive shaft 30 is fixed to the outer wheel 71 of the radial bearing 70, and the second roller unit 20 coupled to the drive cylinder 40 is fixed to the inner wheel 72 of the radial bearing 70. The drive shaft 30 and the drive cylinder 40 are positioned relative to the outer wheel 71 and the inner wheel 72 of the radial bearing 70, respectively. This can ensure that the drive shaft 30 and the drive cylinder 40 are arranged coaxially with each other to rotate about the axis independently without coming into contact with each other.

According to the tube pump 100 of the present embodiment, since the first arrangement position of the first drive unit 50 and the second arrangement position of the second drive unit 60 in the direction orthogonal to the axis X overlap each other, the size of the tube pump 100 in the radial direction RD orthogonal to the axis X can be smaller than in a case where these positions do not overlap. This enables a smaller space in the radial direction RD required for installing the first drive unit 50 and the second drive unit 60.

What is claimed is:

1. A tube pump comprising:

a housing unit formed in an arc shape about an axis and having an inner circumferential surface on which a flexible tube is arranged;

a first contact unit configured to rotate about the axis while being in contact with the tube housed in the housing unit;

a second contact unit configured to rotate about the axis while being in contact with the tube;

a drive shaft arranged on the axis and coupled to the first contact unit;

a drive cylinder arranged on the axis and coupled to the second contact unit;

a first drive unit configured to rotate the drive shaft in a predetermined direction about the axis and having a first drive member configured to rotate about the axis;

a second drive unit configured to rotate the drive cylinder in the predetermined direction about the axis and having a second drive member configured to rotate about the axis; and a radial bearing having an outer wheel fixed to the first contact unit and an inner wheel fixed to the second contact unit, wherein the drive shaft is arranged so as to penetrate through the second drive unit along the axis, the drive shaft being fixed to the outer wheel of the radial bearing via the first contact unit, wherein the drive cylinder is arranged on an outer circumference side of the drive shaft and rotatably about the axis independently of the drive shaft, the drive cylinder being fixed to the inner wheel of the radial bearing via the second contact unit, and wherein the drive shaft and the drive cylinder are positioned relative to the outer wheel and the inner wheel of the radial bearing, respectively.

2. The tube pump according to claim 1, wherein the first drive unit has a first pulse motor configured to rotate the first drive member in the predetermined direction, wherein the second drive unit has a second pulse motor configured to rotate the second drive member in the predetermined direction, wherein the first drive member is coupled to the drive shaft so as to integrally rotate with the drive shaft, and wherein the second drive member is coupled to the drive cylinder so as to integrally rotate with the drive cylinder.

3. The tube pump according to claim 1, wherein the first drive unit and the second drive unit are arranged such that a first arrangement position of the first drive unit in a direction orthogonal to the axis and a second arrangement position of the second drive unit in the direction orthogonal to the axis overlap each other.

4. The tube pump according to claim 1, wherein the first drive unit is configured to rotate the first drive member coaxially with the drive shaft.

5. The tube pump according to claim 1, wherein the second drive unit is configured to rotate the second drive member coaxially with the drive cylinder.

6. The tube pump according to claim 1, wherein the first drive unit is configured to rotate the first drive member coaxially with the drive shaft, and wherein the second drive unit is configured to rotate the second drive member coaxially with the drive cylinder.

7. The tube pump according to claim 1, further comprising a spacer arranged between the first drive unit and the second drive unit.

8. The tube pump according to claim 1, further comprising a position detecting member configured to detect a rotational position about the axis of the first contact unit.

9. The tube pump according to claim 8, further comprising a position detection sensor arranged to interpose an outer circumferential edge of the position detecting member.

10. The tube pump according to claim 1, wherein the first contact unit is a first roller unit, wherein the second contact unit is a second roller unit, and wherein the first roller unit and the second roller unit are configured to rotate independently of each other.

* * * * *